US005973241A

United States Patent [19]

Tetsumura

[11] Patent Number: 5,973,241

[45] Date of Patent: Oct. 26, 1999

[54] KEYBOARD MUSICAL INSTRUMENT HAVING AN IMPROVED COVER OPENING/ CLOSING MECHANISM

[75] Inventor: Naoya Tetsumura, Hamamatsu, Japan

[73] Assignee: Yamaha Corporation, Hamamatsu, Japan

[21] Appl. No.: 09/001,862

[22] Filed: Dec. 31, 1997

[30] Foreign Application Priority Data

Jan. 9, 1997 [JP] Japan ..... 9-013278

[51] Int. Cl.[6] ..... G10C 3/02

[52] U.S. Cl. ..... 84/179; 84/DIG. 17; 206/816; 312/297

[58] Field of Search ..... 84/177, 178, 179, 84/180, 429, 108, DIG. 17; 206/816; 312/297; 160/238

[56] References Cited

U.S. PATENT DOCUMENTS

| | | | |
|---|---|---|---|
| 308,142 | 11/1884 | Cutler | 312/192 |
| 754,815 | 3/1904 | Schriefer | 312/192 |
| 998,178 | 7/1911 | Hosley | 84/423 R |
| 1,782,110 | 11/1930 | Wetzler | 312/192 |
| 1,877,470 | 9/1932 | Mastrangelo et al. | 312/192 |
| 2,070,924 | 2/1937 | Derman | 312/190 |
| 2,220,225 | 11/1940 | Farny | 84/177 |
| 2,351,597 | 6/1944 | Burlin | 312/192 |
| 2,554,665 | 5/1951 | Day | 84/179 |
| 3,248,989 | 5/1966 | Schroth | 84/177 |
| 4,656,913 | 4/1987 | Yoshikawa | 84/177 |
| 5,353,675 | 10/1994 | Kimura et al. | 84/423 R |

FOREIGN PATENT DOCUMENTS

| | | |
|---|---|---|
| 17482 | 9/1904 | Austria . |
| 59-16944 | 5/1984 | Japan . |
| 6-250641 | 9/1994 | Japan . |
| 7-49511 | 11/1995 | Japan . |

*Primary Examiner*—Robert E. Nappi
*Assistant Examiner*—Wesley Scott Ashton
*Attorney, Agent, or Firm*—Graham & James LLP

[57] ABSTRACT

A keyboard musical instrument has a sliding manual cover comprised of a main cover and a sub cover. The main cover is slidable on manual cover guides in forward and rearward directions with respect to the main body between an open position and a closed position. An engaging member is provided on a predetermined portion of the main cover at or closer to an end thereof toward the open position. The sub cover is flexibly coupled to the main cover. A guide device, formed preferably by pinions and guide channels, is provided in the main body in engagement with the sub cover and downwardly guides the sub cover as the main cover is slided on the cover guides toward the open position. At least one support member is mounted in the main body for pivotal movement in the forward and rearward directions, on one end of which is provided an arm which is disposed to engage the engaging member when the main cover is slided on the cover guides toward the open position.

22 Claims, 9 Drawing Sheets

KEYBOARD MUSICAL INSTRUMENT HAVING AN IMPROVED COVER OPENING/CLOSING MECHANISM

BACKGROUND OF THE INVENTION

1. Field of the Invention

The present invention relates to keyboard musical instruments such as electronic organs, and more particularly to improvements in or to the cover opening/closing mechanism of keyboard musical instruments.

2. Prior Art

Conventionally, as a cover for use in keyboard musical instruments, such as electronic organs, there is known a so-called sliding manual cover, which is disposed for sliding motion on a pair of left and right manual cover guides in forward and rearward directions with respect to the main body of a keyboard musical instrument. Further, a cover opening/closing mechanism for keyboard musical instruments having the above-mentioned sliding manual cover is also known from Japanese Utility Model Publication No. 7-49511, which includes a pair of pinions arranged at left and right sides of a rear end of the sliding manual cover (an end thereof in a direction in which the cover is opened), and a pair of racks provided, respectively, on a pair of left and right manual cover guides, and the pinions engage the racks and move along the latter as the sliding manual cover is opened or closed, to thereby permit smooth opening/closing motions of the sliding manual cover.

According to the known cover opening/closing mechanism for keyboard musical instruments, however, it is essentially required to provide in a rear portion of the main body of the keyboard musical instrument a space for accommodation of the sliding manual cover in an open position, which results in an increased axial size of the main body and hence an overall size of the same, leading to an increased cost of the component materials as well as restrictions on the design of the musical instrument. That is, the axial size of the sliding manual cover is determined by the size of the keyboard, the sizes of panels of the musical instrument, etc. and therefore a limitation is imposed upon reducing the size of the sliding manual cover, while on the other hand, when the sliding manual cover is open, the keyboard has to be entirely exposed to the outside, thus automatically determining the minimum required axial size of the space for accommodation of the sliding manual cover.

On the other hand, there is also known from Japanese Utility Model Publication No. 59-16944 a cover opening/closing mechanism for keyboard musical instruments, which is applied to a shutter-like sliding manual cover formed of a plurality of cover components pivotally coupled together to permit the cover to be flexed and has an accommodation space for the sliding manual cover, which is arranged such that as the sliding manual cover is opened, a rear end thereof is downwardly guided on a curved path along a back panel of the musical instrument. According to this known mechanism, the accommodation space for the sliding manual cover downwardly extends such that the axial size of the main body of the keyboard musical instrument can be reduced.

According to the known mechanism, however, since the sliding manual cover is caused to be downwardly suspended, the weight of the sliding manual cover acts upon manual cover slides and a curved portion of the accommodation space, which makes it impossible to smoothly open or close the sliding manual cover. During the closing operation in particular, the user feels the pressure of the sliding manual cover on his hands, while during the opening operation, he feels that his hands are pulled by the sliding manual cover immediately before completion of the opening motion of the cover. These inconveniences cannot be eliminated even if pinions and racks are employed, which engage each other and the pinions move along the racks as the sliding manual cover is opened and closed, still leaving a feeling of unsmoothness due to the weight of the sliding manual cover. This feeling of unsmoothness is particularly strong during the closing operation of the sliding manual cover.

Thus, the conventional cover opening/closing mechanisms have the disadvantage that it is difficult to satisfy the requirements of both reduction of the size of the accommodation space for the sliding manual cover and smooth opening/closing operation of the sliding manual cover, without making the construction complicate.

SUMMARY OF THE INVENTION

It is therefore an object of the invention to provide a keyboard musical instrument having a cover opening/closing mechanism which has a simple construction and can be manufactured at low costs while ensuring smooth opening/closing operation of the cover.

It is another object of the invention to provide a keyboard musical instrument having a cover opening/closing mechanism which can reduce the size of the space for accommodation of the cover and thereby enable large mitigation of restrictions on the design of the main body of the musical instrument.

To attain the above objects, the present invention provides a keyboard musical instrument comprising a main body having a pair of left and right cheeks, a keyboard section and, a pair of cover guides, on the left and right cheeks at inner side surfaces. A main cover slides on the cover guides in forward and rearward directions with respect to the main body between an open position and a closed position, and causes the keyboard section to be exteriorly exposed at least when it is in the open position. A first engaging member is provided on a predetermined portion of the main cover at or closer to an end thereof toward the open position. A sub cover forms a cover together with the main cover and is flexibly coupled to the main cover. Guide channels are provided in the main body and engage the sub cover, for downwardly guiding the sub cover as the main cover is slided on the cover guides toward the open position. At least one support member has one end and is mounted in the main body for pivotal movement in the forward and rearward directions with respect to the main body. A second engaging member provided on the one end of the support member is disposed to engage the first engaging member when the main cover is slided on the cover guides toward the open position.

With the above arrangement, as the main cover is slided on the cover guides toward the open position, the first engaging member engages the second engaging member, whereby the main cover is moved toward a rear portion of the main body while being supported by the support member via the first and second engaging members, and at the same time the sub cover is downwardly guided by the guide channels. On the other hand, as the main cover is slided on the cover guides toward the closed position, the main cover is moved toward a front portion of the main body while being supported by the support member via the first and second engaging members, and at the same time the sub cover is upwardly guided by the guide channels, and then the first engaging member and the second engaging member are disengaged from each other. In this way, even with a simple construction and low manufacturing costs, it is possible to ensure smooth opening/closing operation of the cover, and reduce the space for accommodation of the cover and thereby enable large mitigation of restrictions on the design of the main body of the musical instrument.

Preferably, the keyboard musical instrument according to the invention includes biasing force-generating devices, including for example, a spring, for generating a force acting upon the cover to bias the same toward the closed position when the cover is on a latter half of an opening stroke thereof.

More preferably, the biasing force-generating devices include pivots about which the support member pivotally moves, the support member being mounted on the pivot at a location such that a center of gravity of the support member is positioned, forwardly of the pivot with respect to the main body.

Still more preferably, the support member comprises a generally triangular member having a rear side lower corner, and the support member is mounted on the pivot at the rear side lower corner.

Preferably, the cover guides each have an upper surface inclined rearwardly upwardly of the main body, and the main cover is slidable on the upper surfaces in the forward and rearward directions with respect to the main body between the open position and the closed position.

In a preferred form, the sub cover has a rear end and the guide channel includes a pair of racks provided on the inner side surfaces of the left and right cheeks, a pair of pinions provided at the rear end of the sub cover and engaging the racks, and a pinion shaft having opposite ends thereof on which the pinions are rigidly fitted, the opposite ends of the pinion shaft being slidably fitted in the guide channels.

Advantageously, the first engaging member is mounted on the main cover at a location such that the first engaging member can stably bear in cooperation with the cover guides a load of the main cover and a load of the sub cover applied to the main cover.

In a preferred form, one of the first engaging members and the second engaging member presents a convex shape, and another of the first engaging member and the second engaging member presents a concave shape.

To further facilitate the cover opening/closing operation, the keyboard musical instrument according to the invention may further include a restraint member provided in the main body at a location above the main cover, for restraining a vertical position of the first engaging member to a range within which the first engaging member can engage the second engaging member, when the main cover is slided on the cover guides toward the open position.

By virtue of the provision of the restraint member, when the main cover is slided on the cover guides toward the open position, the restraint member is brought into contact with the upper surface of the main cover, whereby the vertical position of the first engaging member can be controlled to the range within which the first engaging member can engage the second engaging member, when the main cover is slided on the cover guides toward the open position. As a result, even when the sliding of the cover for opening the same is carried out by slightly lifting the front end of the main cover or by lifting the front end of the main cover to such a degree that the upper surface of the main cover contact the restraint member, the first and second engaging members can be positively brought into engagement with each other.

To secure positive opening and closing of the cover even in an event of abnormal operation of opening or closing the cover, the cover opening/closing mechanism may further include auxiliary support members provided in the main body at a location below a pivotal movement path of a portion of the lower surface of the main cover corresponding to the predetermined portion thereof along which the main cover can move with pivotal movement of the second engaging member, for supporting the main cover in an event of abnormal operation of opening or closing the cover.

By virtue of the provision of the auxiliary support members, in the event that the first engaging member jumps over the second engaging member without engaging the same when the main cover is opened with the main body being upset during transportation or the like, or when a forcible opening/closing operation is carried out, it can be prevented that the cover falls down into the interior of the main body, and further the auxiliary support member serves as a guide for the cover when the main cover is pulled toward the closed position, to facilitate returning of the cover into the proper closed position (also the first and second engaging members can be brought into a proper positional relationship). Further, even in the event that the support member is faulty, the auxiliary support member can support the main cover, to thereby secure sliding motions of the cover for opening and closing.

Advantageously, the keyboard musical instrument according to the invention may further include a contact element provided on the sub cover at a rear end thereof, and a cover seating member provided in the main body at a rear side inner surface thereof, for seating the contact element when the cover is in the open position.

To secure positive opening of the cover, the keyboard musical instrument according to the invention may further include at least one second support member having one end and mounted in the main body at a location rearward of the first-mentioned support member, for pivotal movement in the forward and rearward directions with respect to the main body. A third engaging member is provided on the one end of the second support member and is disposed to engage the first engaging member in an event that the first engaging member fails to engage the second engaging member when the main cover is slided on the cover guides toward the open position.

In another preferred form, the sub cover has a front end, and the first engaging member has a lower end, the main cover having a rear end thereof superposed upon the front end of the sub cover, the front end of the sub cover having a lower surface loosely downwardly curved and located slightly below the lower end of the first engaging member.

The support member, the first engaging member and the second engaging member may be provided in a plurality of sets. If only one set of them is provided, advantageously the set may be arranged at a transversely central portion of the main body, while if two sets are provided, advantageously these sets may be arranged at left and right side edges of the main body. If only one set is provided, the construction will be simple, whereas if a plurality of sets are provided, the supportability of the cover will be enhanced, further smoothing the opening/closing motion of the cover.

Also, the main cover and the sub cover may each be formed of a plurality of separate pieces. In this case, the first engaging member should be provided on any piece other than one closest to the open position.

Still further, the auxiliary support member may be provided in a number more than one. For example, one pair of auxiliary support members may be provided on the inner side surfaces of the left and right cheeks, or only one auxiliary support member may be provided at a transversely central portion of the main body. In the former case, the cover can be more stably supported in an event of abnormal operation of opening or closing the cover, and in the latter case, the construction will be simple.

The above and other objects, features, and advantages of this invention will become more apparent from the following detailed description taken in conjunction with the accompanying drawings.

DETAILED DESCRIPTION

The invention will now be described in detail with reference to the drawings showing embodiments thereof.

Figure 1:
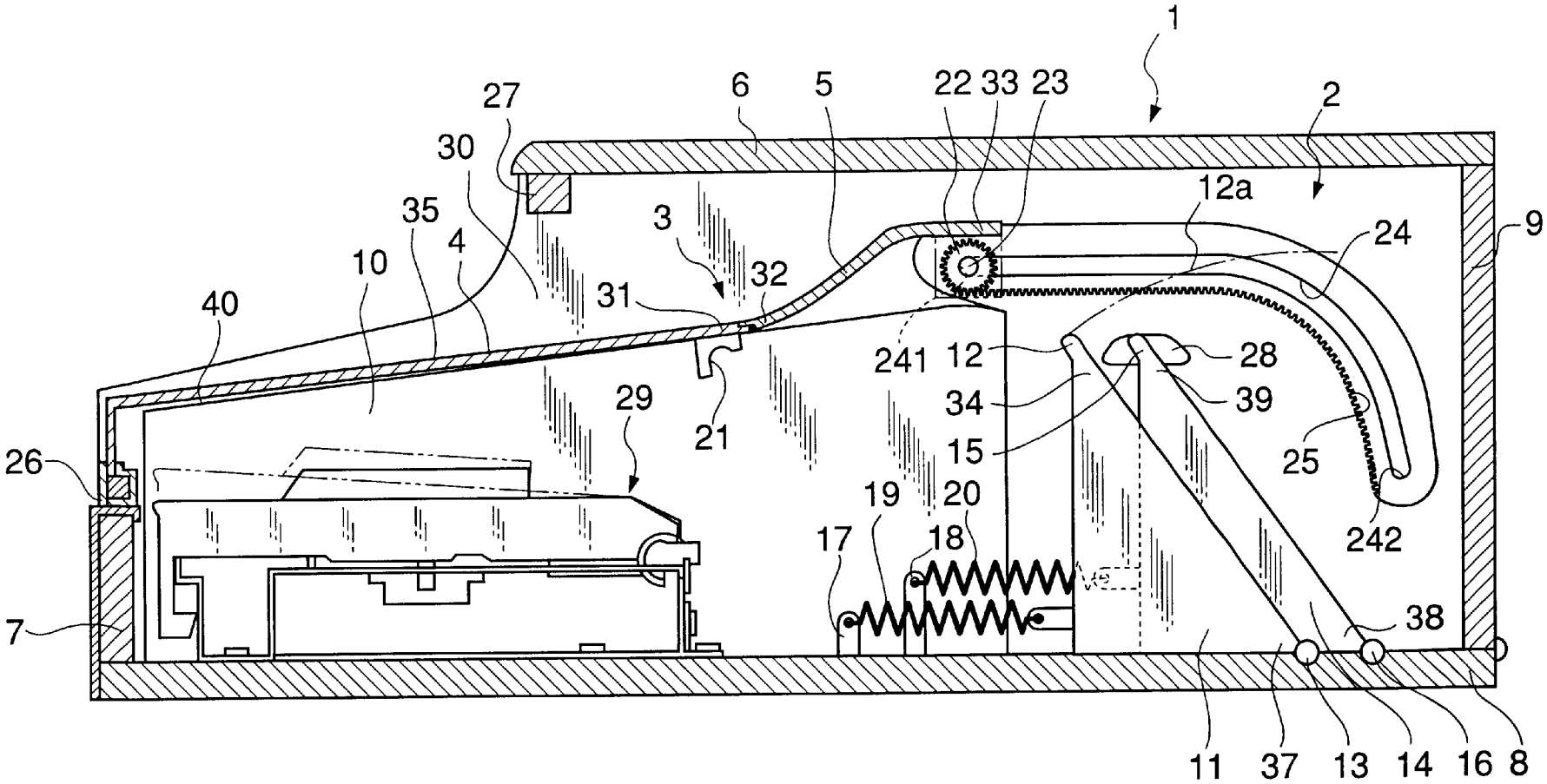
FIG. 1 is a longitudinal vertical sectional view showing a cover opening/closing mechanism of a keyboard musical instrument according to a first embodiment of the invention, in which a cover of the musical instrument is in a closed position.

Referring first to FIG. 1, there is illustrated a cover opening/closing mechanism of a keyboard musical instrument according to a first embodiment of the invention, in which a cover 3, which is a sliding manual cover, is seen to be in a closed position. FIG. 1 is a view taken as viewed from a right side of a main body 1 of the musical instrument, and therefore, a left side as viewed in the figure is a player side (front side), and a right side is a rear side.

The main body 1 is configurated in the form of an oblong shallow box and formed of a bottom board 8, a pair of left and right cheeks 30, a top board 6, a back panel 9, a front panel 7, and the cover 3 which can be manually opened and closed. Arranged inside the main body 1 are a keyboard section 29 comprised of white keys, black keys, electric circuit boards, etc. and arranged on the bottom board 8 in the vicinity of a front end thereof (left end as viewed in the figure), as well as a pair of left and right manual cover guides 10, a pair of left and right pinions 22, a pinion shaft 23, a pair of guide channels 24, and first and second arms 11 and 14 as support members.

The back panel 9 is pivotably coupled at a lower end thereof to a rear end of the bottom board 8 by means of hinges, not shown, while the top board 6 is fixed at a rear end thereof to an upper end of the back panel 9 so that the top board 6 can be pivotally moved rearward together with the back panel 9 about the hinges for maintenance and inspection of the musical instrument, etc.

The left and right cheeks 30 axially extend along the entire axial length of the main body 1 and each have an inner side wall thereof formed integrally with corresponding ones of the manual cover guides 10 and the guide channels 24, a corresponding one of a pair of left and right racks 25, and a corresponding one of a pair of left and right stoppers 28 (auxiliary support members). These elements, however, may be fabricated in separate bodies from the cheeks 30. The following description generally refers to elements and parts on the left side of the musical instrument alone, for the sake of simplicity.

The manual cover guides 10 are each formed integrally on the inner side wall of the corresponding cheek 30 at a front end and upper portion thereof such that a top surface 40 of the cover guide 10 extends almost parallel with a top surface of the cheek 30. The top surface 40 of the cover guide 10 axially extends in a fashion being upwardly inclined toward a rear portion of the main body 1 to an axially central portion of the main body 1 and then further axially extends in a downwardly loosely inclined fashion at a rear end thereof. This inclined configuration of the top surface 40 is for obtaining smooth opening and closing motions of the cover 3.

The cover 3 is comprised of a main cover 4, and a sub cover 5 having a front end 32 thereof pivotably coupled to a rear end 31 of the main cover 4 by hinges, not shown, or the like, and arranged on the cover guide 10 for sliding movement thereon between an open position (a position shown in FIG. 3, referred to hereinafter) and a closed position as shown in FIG. 1. As described in detail hereinafter, when the cover 3 is in the closed position, left and right side edges of the main cover 4 have lower side surfaces thereof placed in contact with the left and right cover guides 10 in a fashion covering a space above the keyboard section 29, while when the cover is opened, left and right side edges of the rear end 31 and left and right side edges of a sash 26 at a front end of the main cover 4 slide on the cover guides 10 so that the cover 3 is accommodated in a rear end portion of the main body 1 to expose the keyboard section 29 to the outside.

The main cover 4 has a downwardly extending front wall, at a lower edge of which is mounted the sash 26 which is disposed for sliding contact with the cover guides 10 when the cover 3 is moved on the cover guides to be opened or closed. The sash 26 extends over the entire keyboard section 29 in a transverse direction with respect to the main body 1, i.e. in a direction in which keys of the keyboard section 29 are arranged (hereinafter referred to as "in the transverse direction" or "transversely"). When the cover 3 is closed, the sash 26 is brought into contact with an upper edge of the front panel 7. An engaging member 21 as first engaging means is provided on a lower surface of the main cover 4. More specifically, the engaging member 21 is secured to a lower surface of the rear end 31 of the main cover 4 at a substantially transversely central location of the main body, by screws or the like, and has a concave lower surface.

The sub cover 5 is upwardly curved toward a rear end 33 thereof and has a pair of pinions 22 mounted on the rear end 33 at left and right side edges thereof. The left and right pinions 22 are rigidly fitted on left and right ends of the pinion shaft 23 transversely extending between the left and right cheeks 30.

The left and right ends of the pinion shaft 23 project outward from the respective left and right pinions 22 and slidably fitted in the respective guide channels 24. The guide channels 24 are each downwardly curved at a region from a central portion to a rear end thereof. This configuration can shorten the axial length of a rear portion of the main body 1 required for securing an accommodation space for the cover 3 in an open position. The rack 25 which engages the corresponding pinion 22 extends parallel with the corresponding guide channel 24 at a lower side of the corresponding guide channel 24. The guide channel 24 and the rack 25 have a length that can cover the distance over which the cover 3 is moved for opening and closing. More specifically, the length of the guide channel 24 and the rack 25 is set such that when the cover 3 is in the closed position, an associated end of the pinion shaft 23 contacts a front end inner surface of the guide channel 24, while when the cover 3 is in the open position, the end of the pinion shaft 23 contacts a rear end inner surface of the guide channel 24. The guide channel 24 and the rack 25 do not only perform a function of guiding the rear end 33 of the sub cover 5 to a lower zone in the rear portion of the main body 1 as the cover 3 is slided toward the open position, but also a function of smoothing the opening and closing motions of the cover 3. Alternatively to the pinion 22 rack 25, and guide channel 24, other means (e.g. a roller and a guide channel, a protuberance and a guide channel, etc.) may be employed as the means for guiding the rear end 33 of the sub cover 5 to the lower zone in the rear portion of the main body 1.

The first arm 11 and the second arm 14 have ends 37 and 38 thereof mounted, respectively, on a first pivot 13 and a second pivot 16 provided on the bottom board 8 at a substantially central location of the rear portion of the main body 1 in the transverse direction. The first arm 11 serves to support the cover 3 during normal opening and closing operations of the cover 3, and the second arm 14 serves to support the cover 3 during abnormal opening and closing operations, hereinafter referred to. Thus, the first arm 11 is a main support member, and the second arm 14 is an auxiliary support member.

The first arm 11 has a front lower edge thereof coupled to an anchor 17 fixed to the bottom forwardly of the first arm 11 via a spring 19, and the second arm 14 has a front lower edge thereof coupled to an anchor 18 fixed to the bottom forwardly of the second arm 14 via a spring 20. The springs 19 and 20 serve to prevent dislocations of the first and second arms 11 and 14 during transportion of the main body 1 or opening or closing operation of the cover 3.

The first and second arms 11, 14 are each formed of a generally triangular plate member made of plastics and having a thickness of approximately 10–20 mm and normally have a lower edge thereof disposed in contact with the upper surface of the bottom board 8. These arms need not be formed of generally triangular plates but may have other shapes, and also may be formed of a metallic material instead of a plastics material. The first arm 11 has an upper end 34 thereof formed integrally with a first protuberance 12 as second engaging means, and the second arm 14 has an upper end 39 thereof formed integrally with a second protuberance 15 as third engaging means, each of the protuberances having an arcuate (convex) tip. These protuberances 12, 15 may be formed in separate bodies from the first and second arms 11, 14, respectively. Each of the protuberances 12, 15 has its tip projected forwardly of the front edge of the corresponding arm 11, 14 so as to avoid interference between a front end of the engaging member 21 and the arm 11, 14 when the protuberance is brought into engagement with the engaging member 21 during opening operation of the cover 3.

The second arm 14 is located rearwardly of the first arm 11 and accordingly the second protuberance 15 is located rearwardly of the first protuberance 12 such that the second protuberance 15 is positioned well inside a pivotal movement path 12*a* of the first protuberance 12 insofar as the cover 3 is opened or closed within its normal opening and closing stroke range. This is to avoid engagement or interference of the engaging member 21 with the second protuberance 15 when the engaging member 21 is revolved about the first pivot 13 in engagement with the first protuberance 12 during normal opening/closing operation of the cover 3.

The first engaging member 21 has its lower surface concaved in the form of a semicircle with a radius of curvature slightly larger than that of the arcuate tips of the first and second protuberances 12, 15 such that it can engage both the first and second protuberances. The size of the engaging member 21 in the transverse direction or the thickness is set to a value substantially larger than the sum of the thicknesses of the first and second arms 11, 14.

The location of the first arm 11 is set such that when the cover 3 is slided toward its closed position by a normal operation, the first protuberance 12 can be brought into engagement with the engaging member 21 midway during the sliding stroke. On the other hand, the location of the second arm 14 is set such that when the cover 3 is opened by an abnormal operation such as by lifting up the cover 3 so that the engaging member 21 does not engage the first protuberance 12 but jumps over the same, the second arm 14 can engage the engaging member 21.

As described in detail hereinafter, by virtue of the provision of the first arm 11, during normal opening/closing operation, the cover 3 is pivotally moved while being supported by the first arm 11, enabling smooth opening/closing motion of the cover 3.

The top board 6 is provided with a restraint member 27 mounted on a lower surface of a front end thereof. The restraint member 27 is brought into contact with an upper surface 35 of the main cover 4 to restrain upward movement of the cover 3 during opening and closing operations of the cover 3. The location and size of the restraint member 27 is set such that the engaging member 21 can engage the second protuberance 15 even when the cover 3 is opened with its front end being lifted up.

The pair of stoppers 28, which are formed on the inner side surfaces of the cheeks 30, serve as auxiliary support members for supporting the cover 3 when the cover 3 is opened or closed without engagement of the engaging member 21 with either of the first protuberance 12 and the second protuberance 15. To this end, the location and configuration of the stoppers 28 are set such that they can support the cover 3 while permitting it to slide thereon. The stoppers 28 each have a flat axially horizontal upper surface with its opposite ends downwardly inclined so as to permit smooth opening/closing motions of the cover 3. The location of the upper surface of each stopper 28 is set such that the upper surface is not positioned above a pivotal movement path of the lower surface of the rear end 31 of the main cover 4 (pivotal movement path 41*a* or 41*b* shown in FIG. 5, referred to hereinafter) when the engaging member 21 is pivotally moved in engagement with the first protuberance 12 or the second protuberance 15. In other words, when the engaging member 21 engages the first protuberance 12 or the second protuberance 15 and revolves about the first pivot 13 or the second pivot 16, the lower surface of the main cover 4 cannot contact the upper surface of the stopper 28. By virtue of this setting, during opening/closing operation of the cover 3 by a normal operation of the cover 3 or a slight abnormal operation of the same, hereinafter described, the main cover 4 does not contact the stoppers 28 and therefore the stoppers 28 can perform the function as the auxiliary support members only in the event of a highly abnormal operation of the cover 3.

More specifically, even when the engaging member 21 does not engage either of the first protuberance 12 and the second protuberance 15 but jumps over them, due to a highly abnormal operation, such as an operation of the cover 3 becoming open or closed with the main body 1 being upset during transportion or the like, an operation of manually opening the cover 3 with the main body 1 being upset, or an operation of forcibly lifting up the whole cover 3 to open the same, the cover 3 can be prevented from falling down into the interior of the main body 1. Further, in such a case, the stoppers 28 support the cover 3 when it is pulled toward the closed position, and thus serve as a guide for the cover 3 to enable the cover 3 to easily return to the initial or proper closed position (such as a position where the engaging member 21 and the first and second protuberances 12, 15 assume a positional relationship as shown in FIG. 1). Moreover, also when the first arm 12 or the second arm 14 becomes faulty, the stoppers 28 can support the main cover 3, thus securing sliding opening/closing motion of the cover 3.

Now, the opening/closing operation of the cover 3 by the cover opening/closing mechanism according to the present embodiment will be described with reference to FIGS. 2 to 6. A normal opening/closing operation will be described with reference to FIGS. 2, 3 and 6, while an abnormal opening/closing operation will be described with reference to FIGS. 4 and 5.

Figure 2:
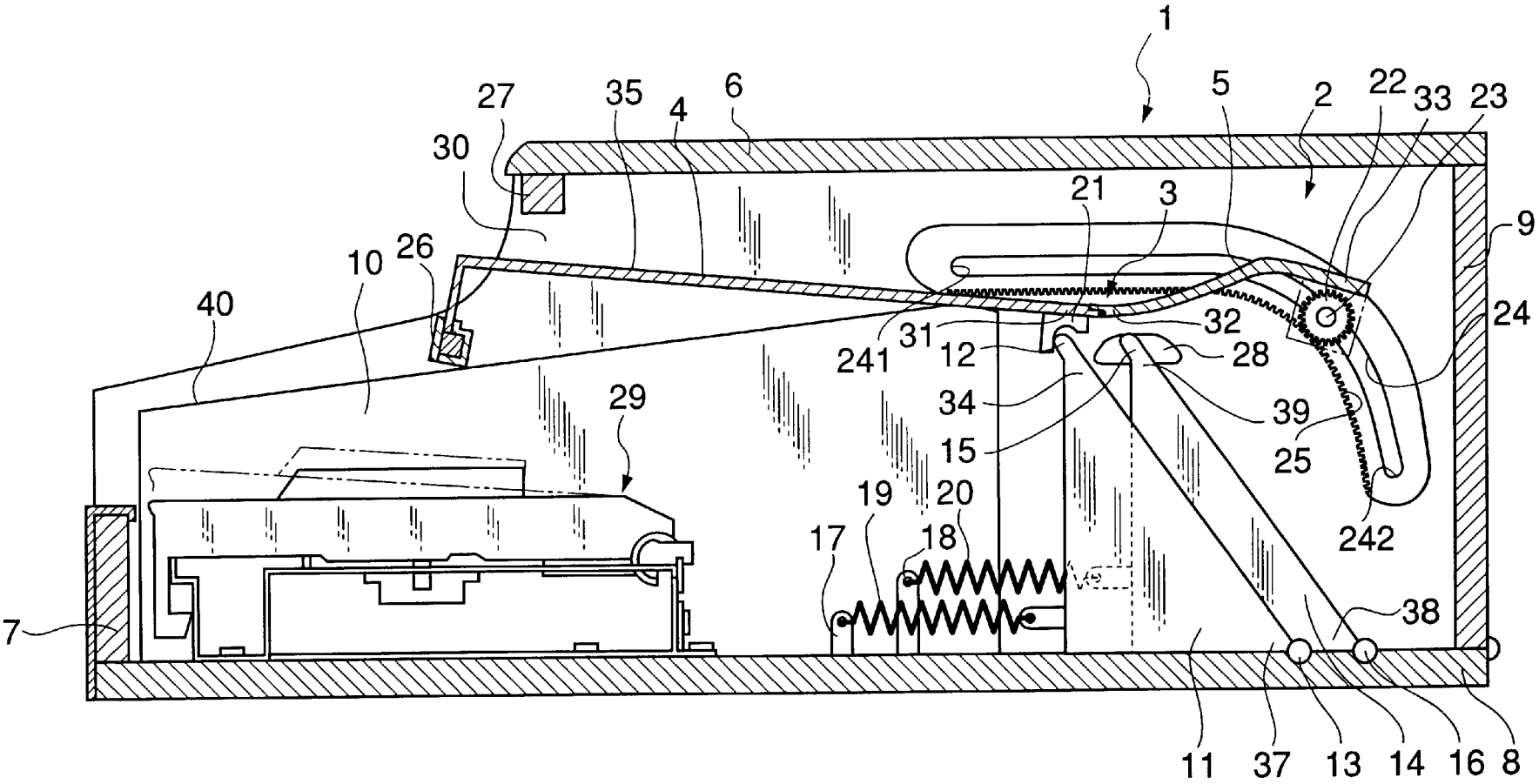
FIG. 2 is a similar view to FIG. 1, showing a state where the cover is in an intermediate position during opening operation thereof, in which it is supported by a first arm.
Figure 3:
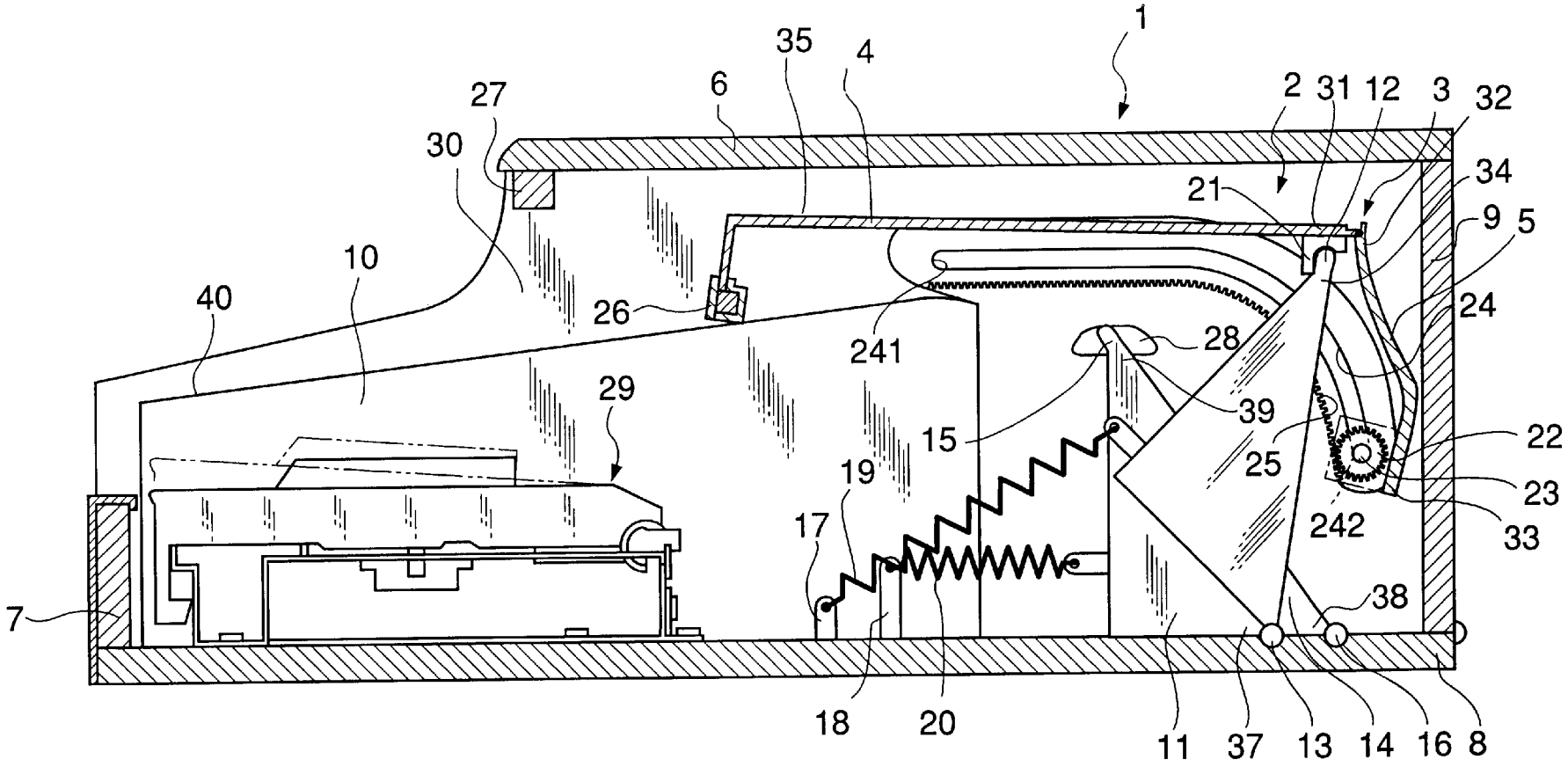
FIG. 3 is a similar view to FIG. 1, showing a state where the cover is in an open position into which it has been brought while being supported by the first arm.

FIG. 2 shows a state where the cover 3 is in an intermediate position during opening operation thereof, in which it is supported by the first arm 11, and FIG. 3 shows a state where the cover 3 is in an open position into which it has been brought while being supported by the first arm 11.

When a player lifts up the front end of the main cover 4 out of a closed position as shown in FIG. 1 and pushes the cover 3 rearward, the lower surfaces of the left and right side edges of the main cover 4 are brought into contact with the inclined rear ends of the upper surfaces 40 of the cover guides 10, and at the same time the lower surface of the left and right side edges of the sash 26 are brought into contact with the upper surfaces 40 of the cover guides 10, and thus the cover 3 is slidingly moved rearward while being supported by the cover guides 10. On this occasion, the left and right ends of the pinion shaft 23 slide along the respective guide channels 24 and accordingly the pinions 22 rotate on the respective racks 25, whereby the rear end 33 of the sub cover 5 is guided rearward.

This sliding movement of the cover 3 is continued until the engaging member 21 becomes engaged with the first protuberance 12.

With a further sliding movement of the cover 3, the engaging member 21 revolves rearward, and accordingly the first arm 11 which then engages the engaging member 21 via the first protuberance 12 pivotally moves rearward about the first pivot 13. With the pivotal movement of the first arm 11, the rear end 33 of the sub cover 5 is downwardly moved rearward along the guide channels 24. On this occasion, the sub cover 5 becomes progressively downwardly bent relative to the main cover 4. Then, after the engaging member 21 passes a point almost above the first pivot 13, the moment acting upon the first pivot 13, which is ascribed to the load of the cover 3 applied to the first arm 11 via the first protuberance 12 turns clockwise with respect to the first pivot 13 as viewed in FIG. 2, and accordingly the cover 3 is drawn rearward, progressively reducing the force required to open the cover 3. More specifically, while the potential energy of the whole cover 3 is maintained at a high level when the cover is in a closed position as shown in FIG. 1, the potential energy decreases as the cover 3 is moved rearward toward the open position so that the center of gravity of the cover lowers. The rate of change in the potential energy is the largest when the cover 3 is moved from the position shown in FIG. 2 to a position shown in FIG. 3 where the sub cover 5 reaches the downwardly inclined rear end portions of the guide channels 24, whereby a retracting force is produced due to the weight of the sub cover 5, which acts upon the cover 3 so as to retract the same relative to the main body 1. On this occasion, the left and right side edges of the sash 26 at the front end of the main cover 4 slidingly moves up on the rearwardly ascending upper surfaces 40 of the cover guides 10, so that the potential energy of the main cover 4 increases to reduce the rate of decrease of the potential energy of the whole cover 4. Accordingly, the rate of increase of the retracting force of the cover 3 decreases, to thereby mitigate the feeling that the operator's hands are pulled by the cover 3 immediately before completion of the cover opening motion.

Further, as means for decreasing the rate of increase of the retracting force, the first arm 11 is configurated generally in the form of a triangle and the first pivot 13 is provided at a rear side lower corner of the arm 11 such that the center of gravity of the arm 11 is located forwardly of the pivot 13 (closer to the player) with respect to the main body 1, and the spring 19 is provided which acts upon the first arm 11 so as to bias the same in the forward or cover closing direction. More specifically, as the cover 3 shifts from the position shown in FIG. 2 to the position shown in FIG. 3, a reaction force is generated by the triangular first arm 11 and the spring 19, which counteracts the opening motion of the cover 3, to thereby decrease the rate of decrease of the potential energy of the whole cover and hence restrain the increase of the retracting force.

When pivotal movement of the cover 3 is further continued so that the opposite ends of the pinion shaft 2 are brought into contact the rear end inner surfaces 242 of the guide channels 24, the cover 3 reaches an open position as shown in FIG. 3 whereby the pivotal movement of the first arm 11 stops. Even in this state, the first protuberance 12 remains engaged with the engaging member 21 and is acted upon by the load of the cover 3. As a result, the first arm 11 will not shake during performance of the musical instrument, etc. and therefore can maintain the cover 3 in a stable state in cooperation with the contact of the sash 26 with the upper surfaces 40 of the cover guides 10.

Since the upper surfaces 40 of the cover guides 10 are upwardly inclined toward the rear ends of the cover guides 10, as mentioned above, as the main cover 4 ascends the upper surfaces 40 during opening operation of the cover 3, the center of gravity of the main cover 4 is upwardly displaced. On the other hand, since the guide channels 24 are downwardly curved toward the rear ends thereof, as mentioned above, as the rear end 33 of the sub cover 5 is downwardly guided during opening operation of the cover 3, the center of gravity of the sub cover 5 is downwardly displaced. Therefore, by properly setting the degree of inclination of the upper surfaces 40 and the curvature of the guide channels 24, it is possible to effectively eliminate the feeling of unsmoothness due to the retracting action of the cover immediately before completion of the closing motion, which is inherent to the conventional sliding manual cover as represented by Japanese Utility Model Publication No. 59-16944, referred to hereinbefore.

Then, when the cover 3 is closed after completion of performance of the musical instrument, by pulling forward the front end of the main cover 4, the cover 3 is returned into the original closed position as shown in FIG. 1 through just reverse movements to those described above. More specifically, with forward movement of the main cover 4, the rear end 33 of the sub cover 5 is progressively upwardly moved along the guide channels 24 to be guided forward. The engaging member 21 moving forward together with the main cover 4 is disengaged from the first protuberance 12 upon completion of counterclockwise pivotal movement of the first arm 11. The cover 3 further slides on the cover guides 10 into the closed position, followed by the lower surface of the sash 26 being brought into contact with the upper surface of the front panel 7. Thus, the closing operation is completed.

In normal opening/closing operation of the cover 3, the engaging member 21 is revolved in engagement with the first protuberance 12 and jumps over the second protuberance 15. Therefore, the second arm 14 remains in its initial position, without performing its function. Further, the main cover 4 moves along the pivotal movement path always located above the stoppers 28 so that the stoppers 28 do not perform their function.

According to the first embodiment described above, by virtue of the provision of the guide channels 24 and its related parts for downwardly guiding the rear end 33 of the sub cover 5 during opening operation of the cover 3, the axial length of the main body 1 can be reduced. Further, the space required for the mechanism for supporting the cover 3 can be greatly reduced by the use of the plate-like first arm 11, thereby reducing the whole size of the main body 1 as well as enhancing the degree of design freedom.

Moreover, since the cover 3 is supported by the first arm 11 during pivotal movement thereof, the cover 3 can be very smoothly opened and closed. In particular, compared with the conventional cover opening/closing mechanism in which a shutter-like sliding manual cover is formed of a plurality of cover components pivotally coupled together and as the sliding manual cover is opened, the rear end thereof is downwardly guided on the curved path, the feeling of unsmoothness that the hands are pulled by the cover 3 immediately before completion of the opening operation can be mitigated, and also the closing operation of the cover 3 can be smoothly carried out.

Besides, the arrangement that the cover 3 is supported by the first arm 11 can greatly simplify the construction of the cover opening/closing mechanism, leading to a reduction in the number of component parts, facilitation of the fabrication, a reduction in the manufacturing cost, etc. As a result, the requirements of both reduction of the size of the accommodation space for the sliding manual cover and smooth opening/closing operation of the sliding manual cover can be satisfied, without making the construction complicate.

Figure 4:
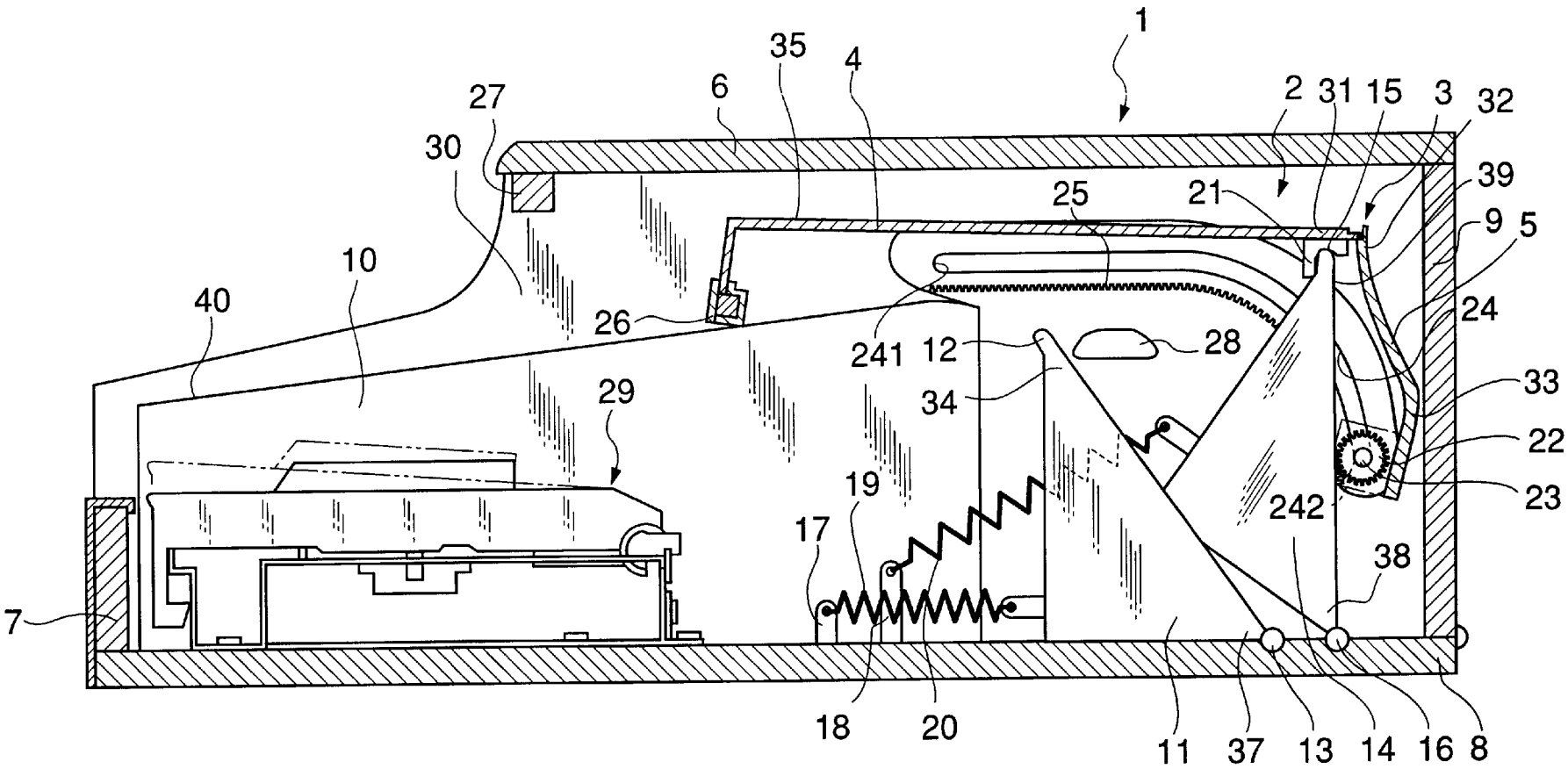
FIG. 4 is a similar view to FIG. 1, showing a state where the cover is in an open position into which it has been brought while being supported by a second arm.

FIG. 4 shows a state where the cover 3 is in an open position into which it has been brought while being supported by the second arm 14.

As described above, during a normal cover opening operation, the engaging member 21 becomes engaged with the first protuberance 12. However, a case can occur where the engaging member 21 jumps over the first protuberance 12 without engaging the same. The second arm 14 is provided to deal with such a case. For example, if the main cover 4 is moved rearward without its lower surface sliding on the cover guides 10 by slightly lifting up the whole main cover 4, the engaging member 21 jumps over the first protuberance 12 without engaging the same. If at this time the cover 3 is further moved rearward, the engaging member 21 becomes engaged with the second protuberance 15. Thereafter, the second arm 14 operates in a manner similar to the operation of the first arm 11 described above.

The pivotal movement path of the engaging member 21 caused by the second arm 14 cannot be set to an optimal path for opening/closing operations as is different from the pivotal movement path caused by the first arm 11. However, the operation of the cover 3 in this case is basically the same with the operation of the same by the first arm 11, providing no hindrance to opening/closing of the cover 3.

By virtue of the provision of the second arm 14, for example, even in the case where the cover 3 is opened while being lifted up to such a degree that the rear end 31 of the main cover 4 does not contact the cover guides 10, or in the case where the first arm 11 becomes faulty, the cover 3 can be opened and closed as smoothly as during normal opening/closing operations. Besides, since the second arm 14 is as simple in construction as the first arm 11, the addition of the second arm 14 does not spoil the merits of reduction of the size of the accommodation space, facilitation of the fabrication, a reduction in the manufacturing cost, etc. Moreover, the provision of the second arm 14 is advantageous in respect of design in that it can absorb slight manufacturing tolerances of the first arm 11.

Figure 5:
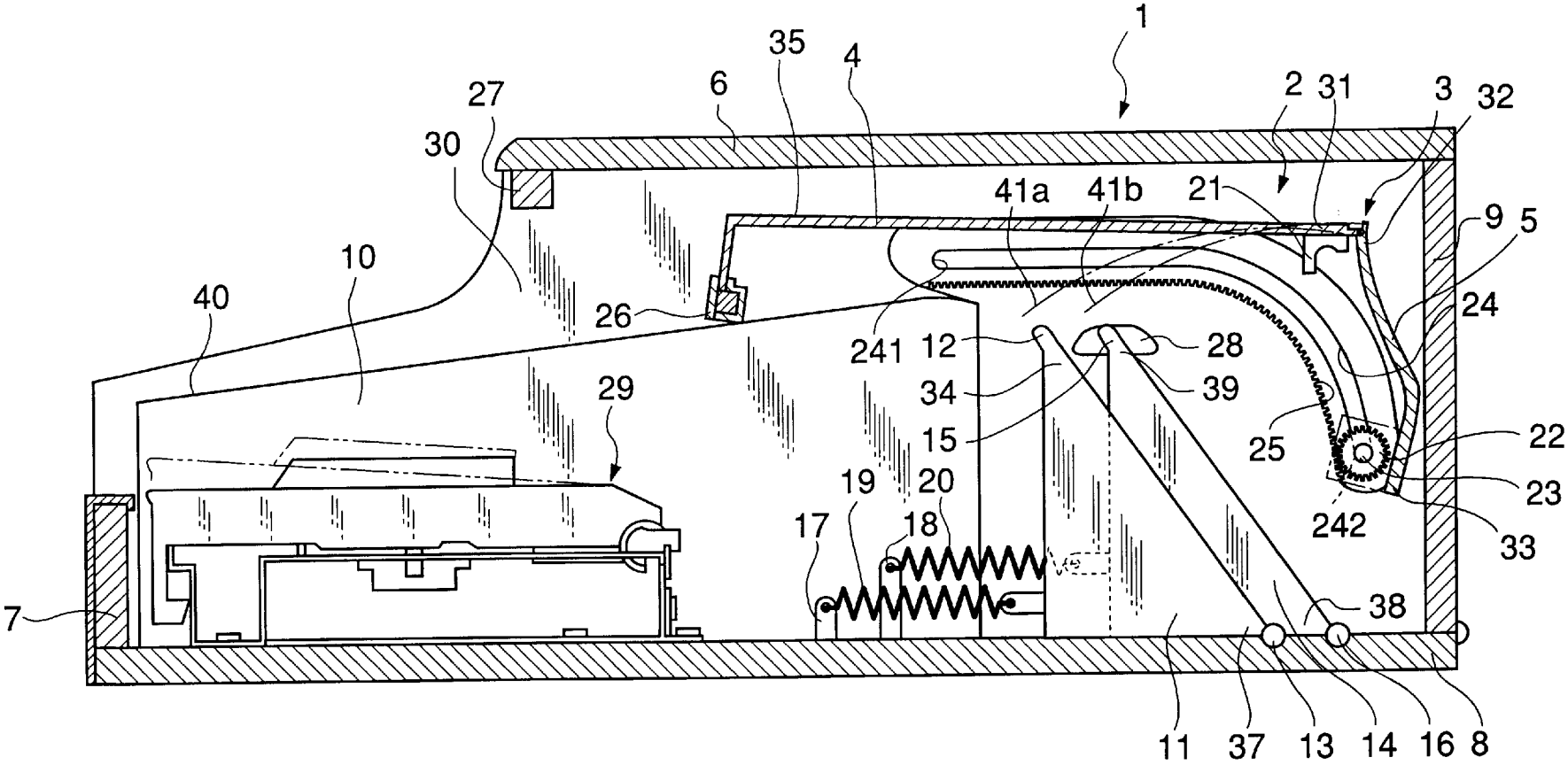
FIG. 5 is a similar view to FIG. 1, showing a state where the cover is in an open position into which it has been brought without being supported by either of the first and second arms.

FIG. 5 shows a state where the cover 3 is in an open position into which it has been brought without being supported by either of the first and second arms 11, 14.

In FIG. 5, a chain line 41*a* represents a pivotal movement path depicted by the lower surface of the rear end 31 of the main cover 4 when the engaging member 21 is pivotally moved in engagement with the first protuberance 12, and a chain line 41*b* represents a pivotal movement path depicted by the lower surface of the rear end 31 of the main cover 4 when the engaging member 21 is pivotally moved in engagement with the second protuberance 15. As stated before, the pivotal movement paths 41*a*, 41*b* are both located above the upper surfaces of the stoppers 28 during the sliding stroke of the cover 3.

When the cover 3 is operated by a normal operation or operated so as to move slightly out of a proper pivotal movement path, the engaging member 21 engages either the first protuberance 12 or the second protuberance 15 and is pivotally moved together therewith. However, as described before, when a highly abnormal operation is carried out, such as an operation of the cover becoming open or closed with the main body 1 being upset during transportion or the like, an operation of manually-opening the cover with the main body 1 being upset, or an operation of forcibly lifting up the whole cover 3 to open the same, there is a possibility that the cover 3 reaches the open position without the engaging member 21 engaging either of the first protuberance 12 and the second protuberance 15 (the case shown in FIG. 5), or the sub cover 5 of the cover 3 becomes outwardly bent relative to the main cover 4 so that the cover 3 falls down into the interior of the main body 1 (not shown). In the present embodiment, these cases can be prevented by the provision of the stoppers 28.

For example, let it now be assumed that both the first arm 11 and the second arm 14 have become faulty (e.g. both have been removed). Under this assumption, if the cover 3 is operated to open, the lower surfaces of the left and right side edges of the main cover 4 slidingly move on the rear ends of the upper surfaces 40 of the cover guides 10, and then slidingly move on the inclined upper surfaces of the front ends of the stoppers 28 onto the flat upper surfaces of the stoppers, followed by sliding thereon, and when the rear end 33 of the sub cover 5 passes the rear ends of the stoppers 28, the sub cover 5 become progressively inwardly bent relative to the main cover 4, and finally the cover 3 is brought into the open position as shown in FIG. 5. That is, the stoppers 28 operate in cooperation with the cover guides 10 to support the cover 3 during the sliding stroke thereof.

When the cover 3 is operated to close from the state shown in FIG. 5 (provided that the first and second arms 11, 14 have been removed), the lower surfaces of the left and right side edges of the main cover 4 slidingly move on the inclined upper surfaces of the rear ends of the stoppers 28 onto the flat upper surfaces of the stoppers 28 on which they further slidingly move toward the closed position, then the main cover 4 passes over the rear ends of the upper surfaces 40 of the cover guides 10 followed by sliding on the upper surfaces 40, and finally the cover 3 is brought into the proper closed position.

Next, let it be assumed that the cover 3 has been opened with the main body 1 being upset. When the cover 3 is operated to close from the state shown in FIG. 5 (provided that the first and second arms 11, 14 have not been removed), during sliding movement of the cover 3 the engaging member 21 sequentially contact the second arm 14 and the first arm 11, but moves along inclined rear end edges of the second arm 14 and the first arm 11 and then smoothly jumps over the second protuberance 15 and the first protuberance 12 to move in the cover closing direction. Therefore, even in this case, the closing operation of the cover can be performed.

As described above, by virtue of the provision of the stoppers 28, it is possible to open and close the cover 3 while preventing the same from falling down into the interior of the main body 1 even in abnormal events as mentioned above.

Figure 6:
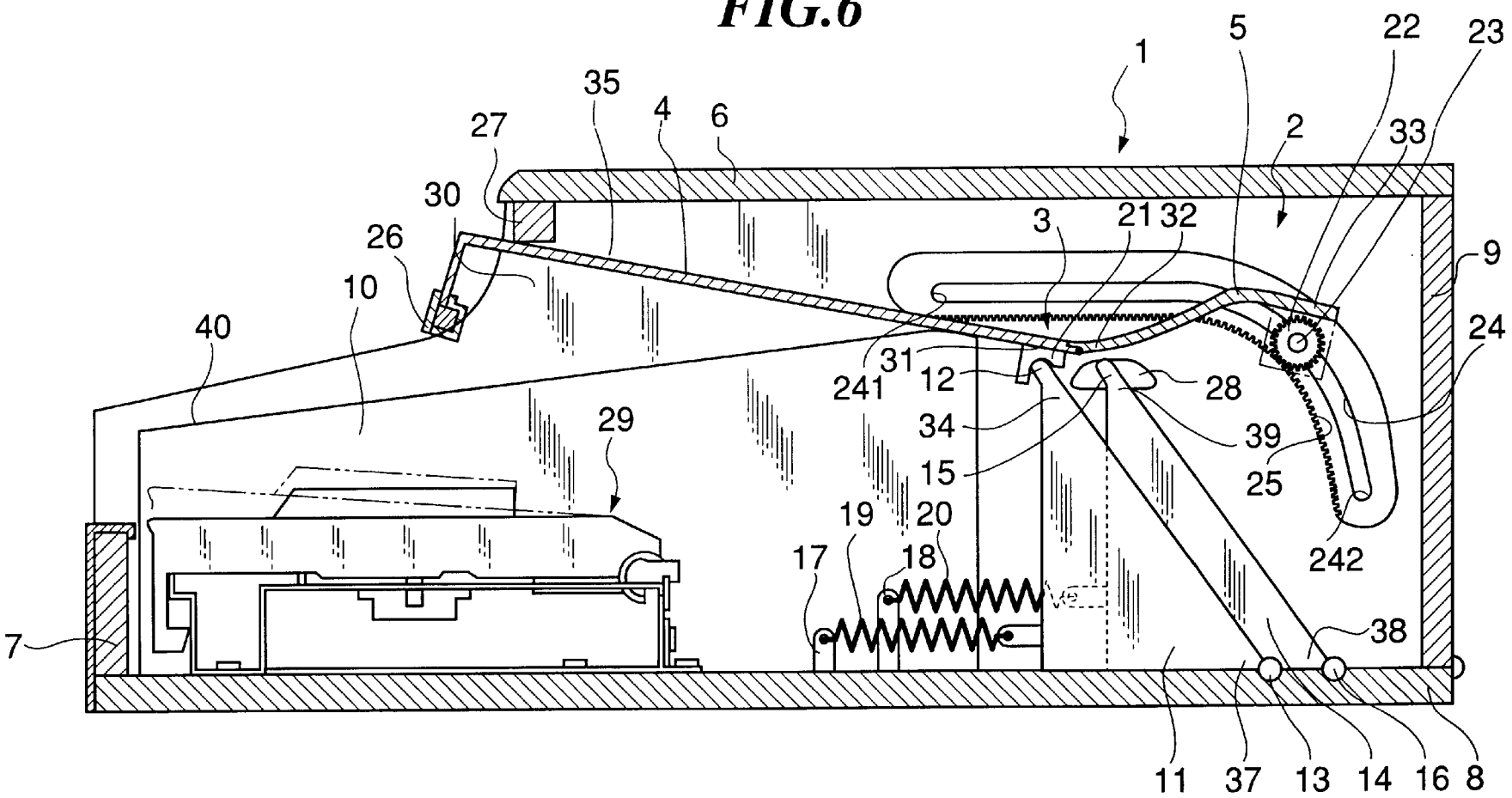
FIG. 6 is a similar view to FIG. 1, showing a state where the cover is in an intermediate position during opening operation thereof, in which a front end of the cover is slightly lifted upward.

FIG. 6 shows a state where the cover 3 is in an intermediate position during opening operation thereof, in which the front end of the cover is slightly lifted upward.

If the cover 3 is merely pushed rearward, the sash 26 slides on the upper surfaces 40 of the cover guides 10. However, in normal opening/closing operation, there can be a case where the cover 3 is opened with the front end of the main cover 4 being slightly lifted up. In this case, the sash 26 does not contact the cover guides 10 but is positioned above the cover guides 10. If the cover 3 is opened or closed with the front end of the main cover 4 being further lifted up, the upper surface 35 of the main cover 4 contacts the lower end of the restraint member 27.

If the cover 3 is pushed toward the open position by maintaining the state in which the front end of the main cover 4 is slightly lifted up, the lower surfaces of the left and right side edges of the main cover 4 are brought into contact with the rear ends of the upper surfaces 40 of the cover guides 10 and the upper surface 35 of the main cover 40 is brought into contact with the lower end of the restraint member 27. On this occasion, the course of movement of the main cover 4 is determined by the hands of the operator who opens the cover 3, the rear ends of the upper surfaces 40 of the cover guides 10 and the lower end of the restraint member 27. Therefore, the vertical position of the engaging member 21 can be controlled, to ensure the engaging member 21 to engage the first protuberance 12 during the sliding stroke of the cover 3 when the cover 3 is opened or closed. By properly setting the position and vertical length of the restraint member 27 so as to control the above position such that the engaging member 21 can engage the first protuberance 12, smooth opening and closing of the cover 3 can be positively performed if the opening/closing operation is a normal operation that can be expected, e.g. an operation of slightly lifting up the front end of the cover 3 to open the cover 3.

As described above, according to the first embodiment, with a simple construction and low manufacturing costs, it is possible to ensure smooth opening/closing operation of the cover 3. Further, it is possible to reduce the size of the space for accommodation of the cover 3 and hence reduce the axial size of the main body 1 of the musical instrument, to thereby enable large mitigation of restrictions on the design of the main body.

A second embodiment of the invention will now be described with reference to FIGS. 7 to 9.

The second embodiment is distinguished from the first embodiment described above not only in that it is applied to a cover different in construction from the cover 3 of the first embodiment, but also in that a cover seating member 42 is provided and the restraint member 27 is omitted. In FIGS. 7 to 9, components and parts corresponding to those in the first embodiment are designated by identical reference numerals, detailed description of which is omitted.

Figure 7:
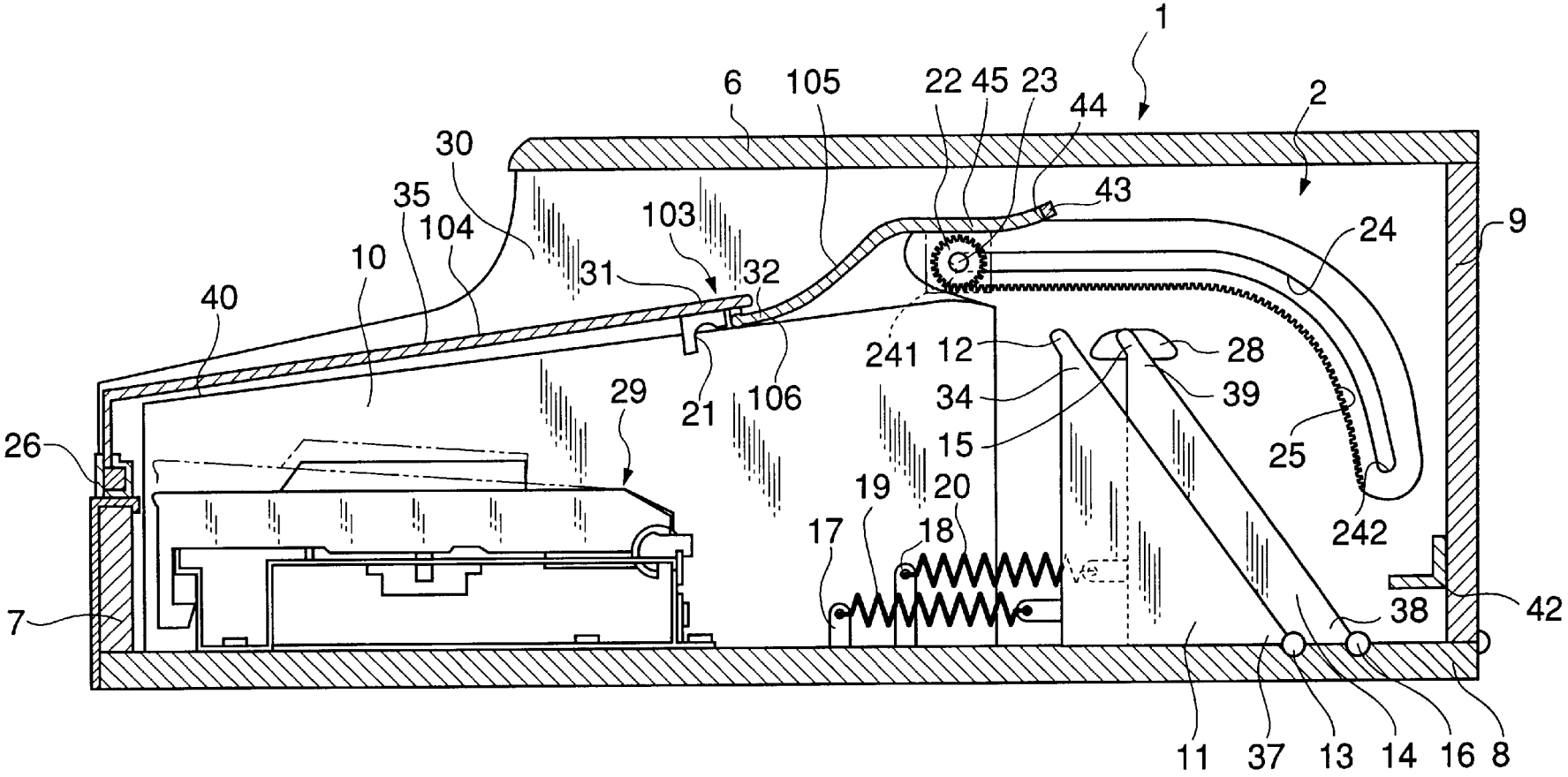
FIG. 7 is a longitudinal vertical sectional view showing a cover opening/closing mechanism of a keyboard musical instrument according to a second embodiment of the invention, in which a cover of the keyboard musical instrument is in a closed position.

FIG. 7 shows a cover opening/closing mechanism of a keyboard musical instrument according to the second embodiment, in which a sliding manual cover 103 of the keyboard musical instrument is in a closed position.

The cover 103 is comprised of a main cover 104, and a sub cover 105 having a front end 32 thereof pivotably coupled to a rear end 31 of the main cover 104, similarly to the cover 4 of the first embodiment. As is distinct from the cover 4 of the first embodiment, the rear end 31 of the main cover 104 is superposed on the front end 32 of the sub cover 105. Except for this, the main cover 104 is identical in construction with the cover 4 of the first embodiment.

In the sub cover 105, the lower surface of the front end 32 is configurated as a curved surface 106 which is loosely downwardly curved. The sub cover 105 is coupled to the main cover 104 such that the curved surface 106 is located at a level slightly lower than a rearward lower end of the engaging member 21. The front end 32 has its front surface located as close to the engaging member 21 insofar as the former does not interfere with the latter.

The rear end 44 of the sub cover 105 is provided with a contact element 43 which is elongate in shape and formed of a resilient material such as rubber and extends in the transverse direction of the main body 1. While the sub cover 5 of the first embodiment has the pinions 22 provided at its rear end 33, the sub cover 105 of the present embodiment has pinions 22 provided at an intermediate portion 45 thereof.

The back panel 9 is provided with the cover receiving member 42 which is elongate in shape and extends in the transverse direction of the main cover 1 along the whole width of the back panel 9. The cover seating member 42 is secured to an inner wall of the back panel 9 at such a location below the rear ends of the guide channels 24 that an upper surface of the cover seating member 42 is brought into contact with the contact element 43 of the sub cover 105 when the cover 103 is in the open position. By virtue of this arrangement, impacts generated at completion of the cover opening motion can be borne over a wider area as compared with the first embodiment in which the opposite ends of the pinion shaft 23 are brought into contact with the rear end inner surfaces of the guide channels 24 at completion of the cover opening motion.

The cover opening/closing operation of the second embodiment will now be described with reference to FIGS. 8 and 9.

Figure 8:
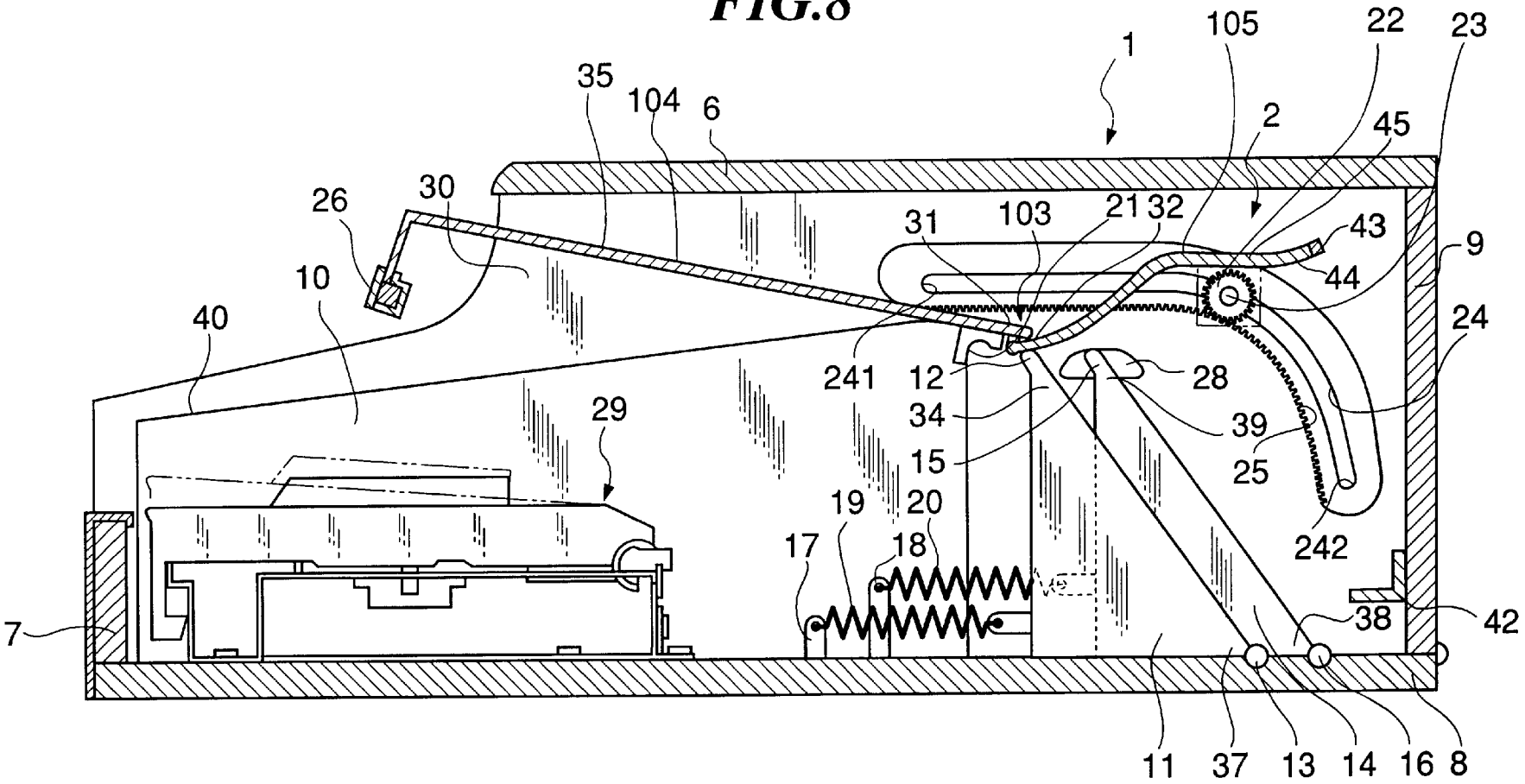
FIG. 8 is a similar view to FIG. 7, showing a state where the cover is in an intermediate position during opening operation thereof, in which it is supported by a first arm.
Figure 9:
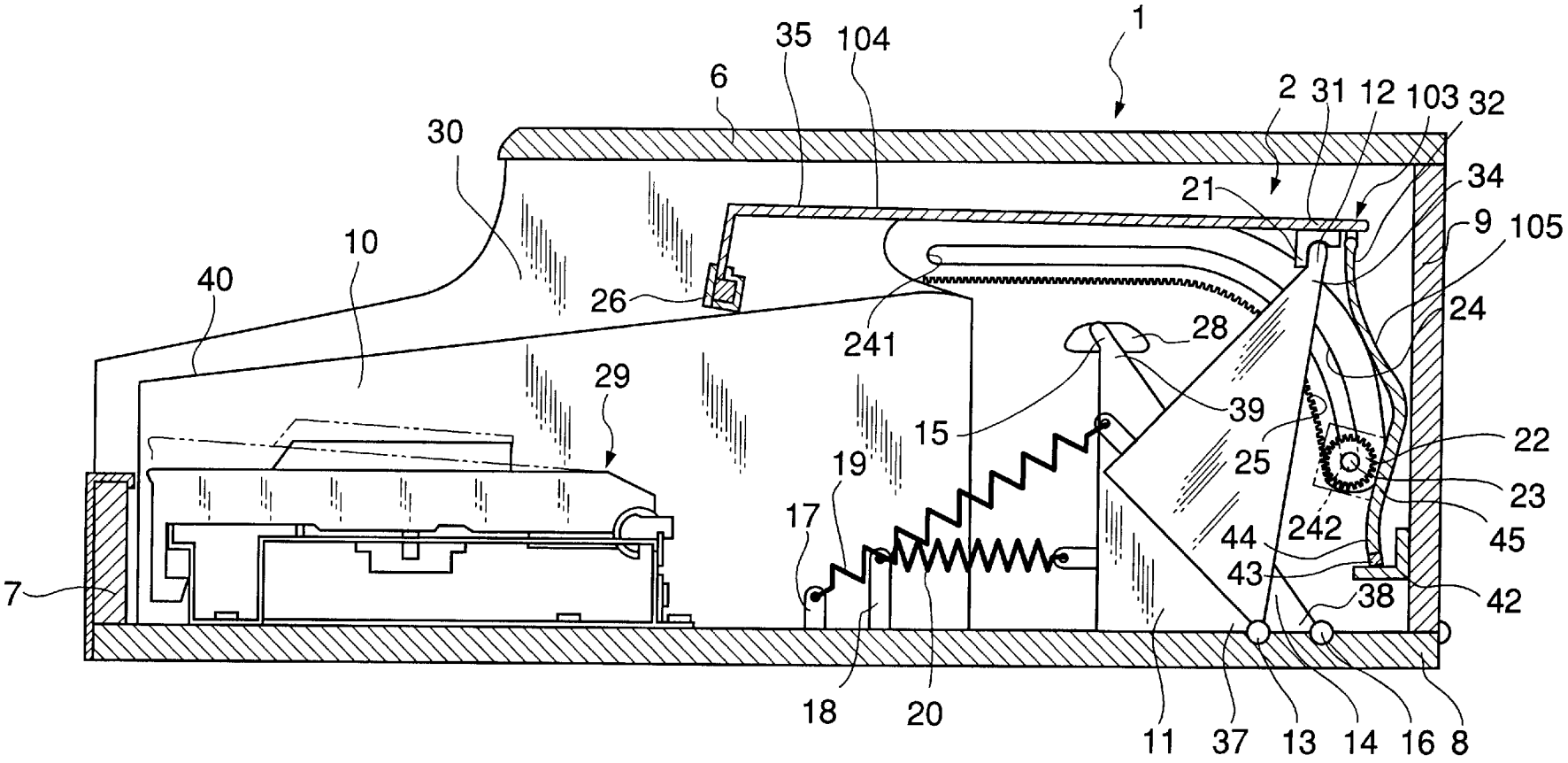
FIG. 9 is a similar view to FIG. 7, showing a state where the cover is in an open position into which it has been brought while being supported by the first arm.

FIG. 8 shows a state where the cover 103 is in an intermediate position during opening operation thereof, in which it is supported by the first arm 11, and FIG. 9 shows a state where the cover 103 is in an open position into which it has been brought while being supported by the first arm 11.

As described hereinbefore, there can be cases where the cover opening operation is carried out by slightly lifting up the front end of the main cover 104. In the second embodiment, since the restraint member 27 is omitted, there is a possibility that during actual normal opening/opening operation, the front end of the main cover is lifted up to a position where the upper surface 35 of the main cover 4 contacts the lower surface of the top board 6.

If the cover 103 is pushed toward the open position with the front end of the main cover 104 held in such a lifted position, initially the curved surface 106 of the sub cover 105 slides on the upper surfaces 40 of the cover guides 10, but after the curved surface 106 passes the rear ends of the cover guides 10, the lower surface of the main cover 104 slides on the upper surfaces 40 of the cover guides 10 until the curved surface 106 is brought into contact with the first protuberance 12 of the first arm 11, as shown in FIG. 8.

As the cover 103 is further pushed rearward, the curved surface 106 slides on the first protuberance 12, and after the curved surface 106 passes the first protuberance 12, the engaging member 21 engages the first protuberance 12. Thus, the curved surface 106 serves as a guide for allowing the engaging member 21 to positively engage the first protuberance 12. The pivotal motions of the engaging member 21, etc. after the engagement of the engaging member 21 with the first protuberance 12 are similar to those of the first embodiment described hereinbefore. Also, the sliding motion of the pinion shaft 23 along the guide channels 24 is basically identical with that of the first embodiment, but in the second embodiment, the intermediate portion 45 of the sub cover 105 is guided downward along the guide channels 24, and accordingly also the rear end 44 of the sub cover 105 is guided downward. As the pivotal motion is further continued, the contact member 43 is brought into contact with the upper surface of the cover seating member 42, as shown in FIG. 9.

According to the second embodiment described above, in addition to effects similar to those of the first embodiment, even if the vertical position of the engaging member 21 somewhat deviates from a proper position during opening or closing operation, the curved surface 106 properly controls the vertical position of the engaging member 21 immediately before the engagement of the engaging member 21 with the first protuberance 12, to thereby enable positive engagement of the engaging member 21 with the first protuberance 12. Therefore, smooth opening and closing of the cover 103 can be positively performed if the opening/closing operation is a normal operation that can be expected, e.g. an operation of slightly lifting up the front end of the cover 103 to open the cover 103.

Further, by virtue of the forwardly downward inclination of the upper surfaces 40 of the cover guides 10 and the curvature of the downwardly extending rear end portions of the guide channels 24, the retracting force acting upon the cover 103 is reduced immediately before completion of the cover opening motion, and by virtue of the use of the contact element 43 formed of a resilient material, the impact of contact of the contact element 43 with the cover seating member 42 is very soft and thereafter the two members are held in engagement with each other in a smooth and stable manner, thereby further reducing the feeling of unsmoothness upon completion of the cover opening motion.

Moreover, the arrangement that the contact element 43 is brought into contact with the cover seating member 42 along the substantially entire transverse length of the main body 1 can provide a higher degree of safety, as compared with the arrangement that the opposite ends of the pinion shaft 23 are brought into contact with the rear end inner surfaces of the guide channels 24. That is, it can prevent an accident such as one that when the operator performs a cover opening operation with an excessive force intentionally or inadvertently, the pinion shaft 23 is bent to impede the cover from being opened or closed.

The first embodiment may be modified to employ the contact element 43 and the cover seating member 42 such that the contact element 43 is brought into contact with the cover seating member 42 when the cover is opened, similarly to the second embodiment.

In the first and second embodiments, the engaging member 21 and the first and second protuberance 12, 15 may have different configurations from those illustrated, insofar as the first protuberance 12 or the second protuberance 15 can stably support the cover 3 or 103 while it engages the engaging member 21. For example, the engaging member 21 may have a convex shape, and the first and second protuberances 12, 15 may have a concave shape. Further, although it is preferable that the mounting location of the engaging member 21 is a location at or close to the rear end 31 of the main cover 4 (104) as in the illustrated embodiments, any other location may be suitable insofar as the engaging member 21 can support the weights of the main cover 4 (104) and the sub cover 5 (105).

Further, in the first and second embodiments, a plurality of sets of the first arm 11 and the second arm 14 may be provided. In addition, the locations of their axes of pivotal movement are not limited to a point on the upper surface of the bottom board 8, but, for example, the pair of cheeks 30 may be provided with pivots and the first arms 11 and the second arms may be mounted on the cheeks 30 via these pivots so as to be pivotally moved about the pivots. Besides, the number of the first arm 11 need not be the same with that of the second arm 14, but the former may be larger than the latter. Moreover, although preferably the number of the engaging member 21 may be the same with that of the first arm 11, the engaging member 21 may be have an elongate configuration having a larger size in the transverse direction of the main body 1 and a plurality of first arms may be provided for the single engaging member 12. As the number of the first arm 11 is larger, the supportability of the cover 3 (103) can be more enhanced, while as the former is smaller, the construction can be more simplified.

Although in the first and second embodiments, as the means for supporting the cover 3 (103), the first and second arms 11, 14 are employed, this is not limitative, but a plurality of third arms may be provided and arranged rearwardly of the second arm 14.

Although in the first and second embodiments, the cover 3 (103) is disposed to cover a space above the keyboard section when it is in the closed position, alternatively it may be disposed to cover not only a space above the keyboard section but also a space above an operating board or switch board including switches for setting tone color, tempo, volume, etc. when it is in the closed position. Further alternatively, the cover may be disposed to cover only a space above the operating board but not a space above the keyboard section when it is in the closed position.

What is claimed is:

1. A keyboard musical instrument comprising:

a main body having a pair of left and right cheeks;

a keyboard section provided in said main body;

a pair of cover guides provided, respectively, on said left and right cheeks at inner side surfaces thereof within said main body of said keyboard musical instrument;

a main cover having opposite sides in a transverse direction with respect to said main body, said main cover being slidable on said cover guides in forward and rearward directions with respect to said main body between an open position and a closed position, said main cover being disposed to cause said keyboard section to be exteriorly exposed at least when it is in said open position;

first engaging means provided on a predetermined portion of said main cover at or closer to an end thereof toward said open position;

a sub cover forming a cover together with said main cover and flexibly coupled to said main cover;

guide means provided in said main body and engaging said sub cover, for downwardly guiding said sub cover as said main cover is slided on said cover guides toward said open position;

at least one support member having one end and mounted in said main body for pivotal movement in said forward and rearward directions with respect to said main body; and second engaging means provided on said one end of said support member and disposed to engage said first engaging means when said main cover is slided on said cover guides toward said open position, wherein said at least one support member is disposed to support said main cover at a location of said main cover other than said opposite sides thereof and against weight of said main cover during sliding of said main cover on said cover guides.

2. A keyboard musical instrument as claimed in claim 1, including biasing force-generating means for generating a force acting upon said cover, which is formed by said sub cover and said main cover, to bias the same toward said closed position when said cover is on a latter half of an opening stroke thereof.

3. A keyboard musical instrument as claimed in claim 2, wherein said biasing force-generating means includes pivot means about which said support member pivotally moves, said support member being mounted on said pivot means at a location such that a center of gravity of said support member is positioned forwardly of said pivot means with respect to said main body.

4. A keyboard musical instrument as claimed in claim 3, wherein said support member comprises a generally triangular member having a rear side lower corner, and said support member is mounted on said pivot means at said rear side lower corner.

5. A keyboard musical instrument as claimed in claim 2, wherein said biasing force-generating means includes spring means acting upon said support member to bias the same in said forward direction of said main body.

6. A keyboard musical instrument as claimed in claim 1, wherein said cover guides each have an upper surface inclined rearwardly upwardly of said main body, and said main cover is slidable on said upper surfaces in said forward and rearward directions with respect to said main body between said open position and said closed position.

7. A keyboard musical instrument as claimed in claim 1, wherein said guide means includes a pair of guide channels provided, respectively, at said inner side surfaces of said left and right cheeks and having a latter half portion thereof inclined rearwardly downwardly of said main body, said guide channels being disposed such that said sub cover is movable along said guide channels.

8. A keyboard musical instrument as claimed in claim 7, wherein said sub cover has a rear end and said guide means includes a pair of racks provided on said inner side surfaces of said left and right cheeks, a pair of pinions provided at said rear end of said sub cover and engaging said racks, and a pinion shaft having opposite ends thereof on which said pinions are rigidly fitted, said opposite ends of said pinion shaft being slidably fitted in said guide channels.

9. A keyboard musical instrument as claimed in claim 1, wherein said first engaging means is mounted on said main cover at a location such that said first engaging means can stably bear in cooperation with said cover guides a load of said main cover and a load of said sub cover applied to said main cover.

10. A keyboard musical instrument as claimed in claim 1, wherein one of said first engaging means and said second engaging means presents a convex shape, and another of said first engaging means and said second engaging means presents a concave shape.

11. A keyboard musical instrument comprising:

a main body having a pair of left and right cheeks;

a keyboard section provided in said main body;

a pair of cover guides provided, respectively, on said left and right cheeks at inner side surfaces thereof within said main body of said keyboard musical instrument;

a main cover slidable on said cover guides in forward and rearward directions with respect to said main body between an open position and a closed position, said main cover being disposed to cause said keyboard section to be exteriorly exposed at least when it is in said open position;

first engaging means provided on a predetermined portion of said main cover at or closer to an end thereof toward said open position;

a sub cover forming a cover together with said main cover and flexibly coupled to said main cover;

guide means provided in said main body and engaging said sub cover, for downwardly guiding said sub cover as said main cover is slided on said cover guides toward said open position;

at least one support member having one end and mounted in said main body for pivotal movement in said forward and rearward directions with respect to said main body;

second engaging means provided on said one end of said support member and disposed to engage said first engaging means when said main cover is slid on said cover auides toward said open position; and restraint means provided in said main body at a location above said main cover, for restraining a vertical position of said first engaging means to a range within which said first engaging means can engage said second engaging means, when said main cover is slided on said cover guides toward said open position.

12. A keyboard musical instrument comprising:

a main body having a pair of left and right cheeks;

a keyboard section provided in said main body;

a pair of cover guides provided, respectively, on said left and right cheeks at inner side surfaces thereof within said main body of said keyboard musical instrument;

a main cover slidable on said cover guides in forward and rearward directions with respect to said main body between an open position and a closed position, said main cover being disposed to cause said keyboard section to be exteriorly exposed at least when it is in said open position;

first engaging means provided on a predetermined portion of said main cover at or closer to an end thereof toward said open position;

a sub cover forming a cover together with said main cover and flexibly coupled to said main cover;

guide means provided in said main body and engaging said sub cover, for downwardly guiding said sub cover as said main cover is slided on said cover guides toward said open position;

at least one support member having one end and mounted in said main body for pivotal movement in said forward and rearward directions with respect to said main body; and second engaging means provided on said one end of said support member and disposed to engage said first engaging means when said main cover is slid on said cover guides toward said open position, wherein said main cover has a lower surface, and the instrument further includes auxiliary support means provided in said main body at a location below a pivotal movement path of a portion of said lower surface of said main cover corresponding to said predetermined portion thereof along which said main cover can move with pivotal movement of said second engaging means, for supporting said main cover in an event of abnormal operation of opening or closing said cover formed by said sub cover and said main cover.

13. A keyboard musical instrument comprising:

a main body having a p air of left and right cheeks;

a keyboard section provided in said main body;

a pair of cover guides provided, respectively, on said left and right cheeks at inner side surfaces thereof within said main body of said keyboard musical instrument;

a main cover slidable on said cover guides in forward and rearward directions with respect to said main body between an open position and a closed position, said main cover beino disposed to cause said keyboard section to be exteriorly exposed at least when it is in said open position;

first engaging means provided on a predetermined portion of said main cover at or closer to an end thereof toward said open position;

a sub cover forming a cover together with said main cover and flexibly coupled to said main cover;

guide means provided in said main body and engaging said sub cover, for downwardly guiding said sub cover as said main cover is slided on said cover guides toward said open position;

at least one support member having one end and mounted in said main bold for pivotal movement in said forward and rearward directions with respect to said main body;

second engaging means provided on said one end of said support member and disposed to engage said first engaging means when said main cover is slid on said cover guides toward said open position; and a contact element provided on said sub cover at a rear end thereof, and a cover seating member provided in said main body at a rear side inner surface thereof, for seating said contact element when said cover is in said open position.

14. A keyboard musical instrument comprising:

a main body having a pair of left and right cheeks;

a keyboard section provided in said main body;

a pair of cover guides provided, respectively, on said left and right cheeks at inner side surfaces thereof within said main body of said keyboard musical instrument;

a main cover slidable on said cover guides in forward and rearward directions with respect to said main body between an open position and a closed position, said main cover being disposed to cause said keyboard section to be exteriorly exposed at least when it is in said open position;

first engaging means provided on a predetermined portion of said main cover at or closer to an end thereof toward said open position;

a sub cover forming a cover together with said main cover and flexibly coupled to said main cover;

guide means provided in said main body and engaging said sub cover, for downwardly guiding said sub cover as said main cover is slided on said cover guides toward said open position;

at least one support member having one end and mounted in said main body for pivotal movement in said forward and rearward directions with respect to said main body;

second engaging means provided on said one end of said support member and disposed to engage said first engaging means when said main cover is slid on said cover guides toward said open position; and at least one second support member having one end and mounted in said main body at a location rearward of said first-mentioned support member, for pivotal movement in said forward and rearward directions with respect to said main body, and third engaging means provided on said one end of said second support member and disposed to engage said first engaging means in an event that said first engaging means fails to engage said second engaging means when said main cover is slided on said cover guides toward said open position.

15. A keyboard musical instrument comprising:

a main body having a pair of left and right cheeks;

a keyboard section provided in said main body;

a pair of cover guides provided, respectively, on said left and right cheeks at inner side surfaces thereof within said main body of said keyboard musical instrument;

a main cover slidable on said cover guides in forward and rearward directions with respect to said main body between an open position and a closed position, said main cover being disposed to cause said keyboard section to be exteriorly exposed at least when it is in said open position;

first engaging means provided on a predetermined portion of said main cover at or closer to an end thereof toward said open position;

a sub cover forming a cover together with said main cover and flexibly coupled to said main cover;

guide means provided in said main body and engaging said sub cover, for downwardly guiding said sub cover as said main cover is slided on said cover guides toward said open position;

at least one support member having one end and mounted in said main body for pivotal movement in said forward and rearward directions with respect to said main body; and second engaging means provided on said one end of said support member and disposed to engage said first engaging means when said main cover is slid on said cover guides toward said open position, wherein said sub cover has a front end, and said first engaging means has a lower end, said main cover having a rear end thereof superposed upon said front end of said sub cover, said front end of said sub cover having a lower surface loosely downwardly curved and located slightly below said lower end of said first engaging means.

16. A keyboard musical instrument as claimed in claim 1, wherein said at least one support member is disposed to be normally in a position not supporting said main cover and starts to be pivotally moved to support said main cover when said first engaging means engages said second engaging means at a predetermined intermediate position during sliding of said main cover on said cover guides toward said open position.

17. A keyboard musical instrument as claimed in claim 1, wherein said cover guides each has an upper surface inclined rearwardly and upwardly of said main body, said main cover being slidable on said upper surfaces in said forward and rearward directions with respect to said main body between said open position and said closed position, said guide means including a pair of guide channels provided, respectively, at said inner side surfaces of said left and right cheeks and having a latter half portion thereof inclined rearwardly and downwardly of said main body, said guide channels being disposed such that said sub cover is movable along said guide channels.

18. A keyboard musical instrument as claimed in claim 1, further including restraint means provided in said main body at a location above said main cover, for restraining a vertical position of said first engaging, means to a range within which said first engaging means can engage said second engaging means, when said main cover is slid on said cover guides toward said open position.

19. A keyboard musical instrument as claimed in claim 1, wherein said main cover has a lower surface, and the instrument further includes auxiliary support means provided in said main body at a location below a pivotal movement path of a portion of said lower surface of said main cover corresponding to said predetermined portion thereof along which said main cover can move with pivotal movement of said second engaging means, for supporting said main cover in an event of abnormal operation of opening or closing said cover formed by said sub cover and said main cover.

20. A keyboard musical instrument as claimed in claim 1, further including a contact element provided on said sub cover at a rear end thereof, and a cover seating member provided in said main body at a rear side inner surface thereof, for seating said contact element when said cover is in said open position.

21. A keyboard musical instrument as claimed in claim 1, further including at least one second support member having one end and mounted in said main body at a location rearward of said first-mentioned support member, for pivotal movement in said forward and rearward directions with respect to said main body, and third engaging means provided on said one end of said second support member and disposed to engage said first engaging means in an event that said first engaging means fails to engage said second engaging means when said main cover is slid on said cover guides toward said open position.

22. A keyboard musical instrument as claimed in claim 1, wherein said sub cover has a front end, and said first engaging means has a lower end, said main cover having a rear end thereof superposed upon said front end of said sub cover, said front end of said sub cover having a lower surface loosely downwardly curved and located slightly below said lower end of said first engaging means.

* * * * *